United States Patent [19]

Lancelot

[11] Patent Number: 4,888,922

[45] Date of Patent: Dec. 26, 1989

[54] SETTING HOIST ANCHORS IN POURED CONCRETE STRUCTURES

[75] Inventor: Harry B. Lancelot, Hurst, Tex.

[73] Assignee: Richmond Screw Anchor Co., Inc., Fort Worth, Tex.

[21] Appl. No.: 233,089

[22] Filed: Aug. 15, 1988

[51] Int. Cl.[4] ..... E04B 1/38; E04B 1/60

[52] U.S. Cl. ..... 52/124.2; 52/223 L; 52/699; 52/741; 249/217; 249/219.1

[58] Field of Search ..... 52/124.2, 223 L, 699–701, 52/741; 249/91, 95, 177, 185, 217, 219.1

[56] References Cited

U.S. PATENT DOCUMENTS 3,680,826 8/1972 Bassani ..... 249/91

4,000,591 1/1977 Courtois ..... 52/125.4

*Primary Examiner*—James L. Ridgill, Jr.

*Attorney, Agent, or Firm*—Natan Epstein; Ralf H. Siegemund

[57] ABSTRACT

A kit of parts and method for setting a hoist anchor in a poured concrete structure includes a hemispherical rubber void body having an anchor head receiving cavity therein, the body including the cavity being partially split into two quarter sphere halves hingedly joined at a flat side of the body to allow hinging separation of the halves for insertion of an anchor head into said cavity, and a mounting stud threaded into a washer inside the void body cavity for drawing the center of the flat side against a concrete forming member thereby to flatten the flat side and urge the halves against each other to seal the void body against fluid concrete. Four variants of the kit are disclosed.

26 Claims, 7 Drawing Sheets

58
56
66
16
75
18
70
72
74
12
10
14

58
56
16
18
42
12
14

75
70
72
74
28
22
16
18
42
14
12
10
14

58
56
66
52
45a
16
40
42
20
18
66
40

22
28
24
36
38
28
22
26
24
32
30
36
34

SETTING HOIST ANCHORS IN POURED CONCRETE STRUCTURES

FIELD OF THE INVENTION

The present invention pertains generally to the field of hoisting equipment used in the erection of poured concrete structures and more particularly relates to improvements in the devices and methods used for setting hoist anchors into concrete, so that the structure may be subsequently hoisted by these anchors.

BACKGROUND OF THE INVENTION

It has been a long known practice to embed anchors of various designs in poured concrete structures by mounting the anchor to some portion of the form into which the concrete is poured, usually a wooden framework which serves as a template or mold for the initially fluid concrete. After the concrete has set and hardened, the form is disassembled and removed to expose the concrete as well as the anchors set therein. A hoist line provided wtih a suitable coupler, for which many designs exist, may then be connected to one or more partially embedded anchors and the concrete structure then erected, lifted or otherwise handled in a convenient and safe manner.

One commonly used type of hoist anchor is the so-called "dog bone" anchor consisting of a straight steel shaft terminating at each end in an enlarged anchor head. Most of the shaft as well as one head is embedded in concrete while the opposite head and a short portion of the anchor shaft remain exposed within a hemisperhical depression in the concrete surface. Such anchors are used with hoist coupling devices which include a hemispherical coupler body designed to mate into the hemispherical depression and receive the exposed anchor head. A latching mechanism locks the anchor head within the coupler body preventing separation of the two during hositing of the concrete structure.

The "dog bone" anchor is typically set in the poured concrete structure by first fitting one end of the anchor i.e., the end that is to remain exposed, within a hemipherical rubber void. The rubber void is a solid rubber body of hemispherical shape, i.e. having a flat top surface and a hemispherical undersurface. The hemispherical portion of the body is split diametrically through most of the height of the void body, the height being the radius line perpendicular to the flat top surface, so that the two halves remain joined by a relatively small thickness of rubber at the flat top surface. It is therefore possible to spread apart the two halves of the void body at the split line with a resilient flexible hinged connection joining the two halves. A cavity shaped to receive the anchor head is centered in the void body and this cavity opens to the exterior at the center of the hemispherical undersurface. The cavity is divided equally between the two havles of the void body. One head of the anchor is inserted into the void body cavity and is captured between the two halves. The cavity opening narrows around the anchor shaft and prevents the larger anchor head from being withdrawn unless the void body halves are spread apart. The rubber void is then mounted, by means of screws or the like, to the inner surface of the wooden form so that the rest of the anchor extends into the form cavity into which concrete is to be poured. The flat side of the rubber void is fixed to the form surface, which keeps the ruvbber void from spreading open and holds the anchor in place until the concrete is poured and sets. After the wooden form is removed, the rubber void is cut away and discarded, leaving a hemisperhical void in the concrete with the exposed anchor head fixed therein in proper position for mating with an appropriate hoist coupler.

Difficulties have been experienced in the past with this approach due to the susceptibility of fluid concrete to leak into the rubber void and enter the anchor head cacity where the concrete solidifies, making subsequent removal of the rubber void difficult and making it impossible to connect the hoist coupler to the anchor head until the solidified concrete has been removed. These difficulties introduce delays and increase the cost of a construction project. A continuing need exists therefore for improved methods and equipment for setting the anchor hoists in poured concrete structures which will positively exclude concrete from the rubber voids to eliminate the aforedescribed problem.

SUMMARY OF THE INVENTION

This invention provides an improved kit of parts for use in setting a hoist anchor into a poured concrete structure. The kit comprises a hemispherical rubber void body having an anchor head receiving cavity therein, the body being split into two quarter sphere halves along a meridian arc on the hemispherical underside and joined by a relatively thin thickness of rubber at a flat upper side of the void body to allow hinging separation of said halves for insertion of an anchor head into the cavity which is divided between the two halves; a threaded setting stud insertable into the void body cavity through a stud hole centered in the flat side of the void body; a hoist anchor including an anchor shaft terminating in an enlarged anchor head inserted into said receiving cavity; a washer element threaded on the inner end of the stud in the cavity between the anchor head and the flat side of the void body; a retaining nut threadable on the exposed portion of the mounting stud against the outer surface of a wooden concrete form perforated to admit the stud so as to draw the flat side of the void body against the inner surface of the form thereby to force the two halves together about the anchor shaft to close the void body cavity against fluid concrete. Raised areas may be provided on the flat top of the void body on either side of the hinge line between the two havles, the raised portions acting as wedge bewteen the void body and the concrete form to more firmly urge together and seal the two halves along the split line.

Four variations of the anchor setting kit are disclosed.

In a first embodiment the washer element is a rectangular adapter frame adapted to fit over an anchor head and hold the anchor captive against axial withdrawal within the void body. Further, the stud may be threaded tight against the captive anchor head to clamp the anchor head within the adapter frame during pouring and setting of the concrete.

In a second embodiment the washer element is a flat washer plate which is drawn by the mounting stud against an end wall of the void body cavity to urge closure of the void body when it is mounted to the concrete form, but neither the washer nor the stud engage the anchor which is retained to the void body by the restricted bottom opening in the voil body which closely encompasses the anchor shaft but will not pass the anchor head while the void body is held closed.

In a third embodiment the washer element is similar to that of the second, but the anchor has an internally threaded axial blind hole in one or both ends. The mounting stud threads through the washer and into the anchor end to securely hold the anchor head in the void body.

In a fourth variation of this invention, a kit of parts for use in setting a hoist anchor in poured concrete comprises a hemispherical rubber void body partially split into two halves joined by a layer of rubber at a flat side of said body to allow hinging separation of said halves, as above, but having an internal metallic shell divided into two complementary halves. Each complementary half of the metal shell is embedded in one half of the void body in mutually opposing relationship, and together define a shell cavity adapted to capture the head of an anchor inserted into the void body. A threaded setting stud is insertable into the shell cavity through a stud hole centered in the flat side of the void body, and a retaining washer is threadable onto the stud end to make and interference fit with an apertured end wall of the metal shell and hold the stud against withdrawal from the shell cavity. As in the other forms of the invention, a retaining nut is threadable on an exposed portion of the stud against the outer surface of a concrete form perforated to admit the stud for drawing the flat side of the void body against a planar inner surface of the form thereby to force together the void body halves and the complementary halves thereby to capture an anchor head inserted therebetween and close the shell cavity against entry of fluid concrete.

In all variations of the invention here described, additional protection against seepage of concrete into the void body may be obtained by a shield unit made of impermeable sheet material such as latex fitted over and closely conforming to the hemispherical shape of the void body to cover the split line between the two halves and including an opening closely passing the anchor shaft and preferably including an elastic sleeve closely fitted over a portion of the anchor shaft to seal the bottom opening into the void body cavity. The impermeable seal is fitted over the void body with an anchor previously inserted in the void body, and before mounting the void body/anchor assembly to the concrete form, such that after tightening the void body to the concrete form by means of the retaining nut the annular rim of the latex seal is held captive between the void body and the concrete form to secure the seal in place during subsequent pouring of concrete into the form.

In an alternate form of the impermeable seal a latex hemispherical cup with a closed nipple formed in its center is placed over the anchor head. The anchor head covered by the nipple is then inserted into the rubber void, and the portion of the latex shield which remains outside the rubber void is reversed and pulled over the void body, thereby providing a continuous impermeable barrier between the void body on the inside and the anchor and the fluid cement on the outside.

It is contemplated that the impermeable shield unit may be also used in the aforedescribed manner with currently used hemispherical rubber voids to improve their sealing characteristics even without benefit of the other improvements disclosed herein.

The anchor setting kit of this invention is assembled by threading one end of the mounting stud into the washer or adapter frame, inserting the stud with the washer and adapter frame into the void body cavity and then through a stud hole in the top of the void body such that the washer is disposed against an end wall of the cavity and a portion of the stud extends from the flat side of the body. The anchor head is then inserted into the receiving cavity and fitted within the adapter frame if one is used, or threaded to the mounting stud if the anchor shaft is tapped and drilled. The exposed portion of the mounting stud is then inserted through a stud mounting hole in a wooden concrete form and a retaining nut is threaded on the exposed end of the stud and tightened against the outer surface of the form for drawing the flat side of the void body against the inner surface of the form thereby forcing the halves together about the anchor to close the cavity against concrete to be poured into the form. Optionally, the shield unit may be slipped over the hoist anchor and onto the void body before mounting the assembly to the concrete form as has just been described to capture the annular flange of the shield.

DETAILED DESCRIPTION OF THE PREFERRED EMBODIMENTS

Figures 1A, 1B, 1C, 1D, 1E:
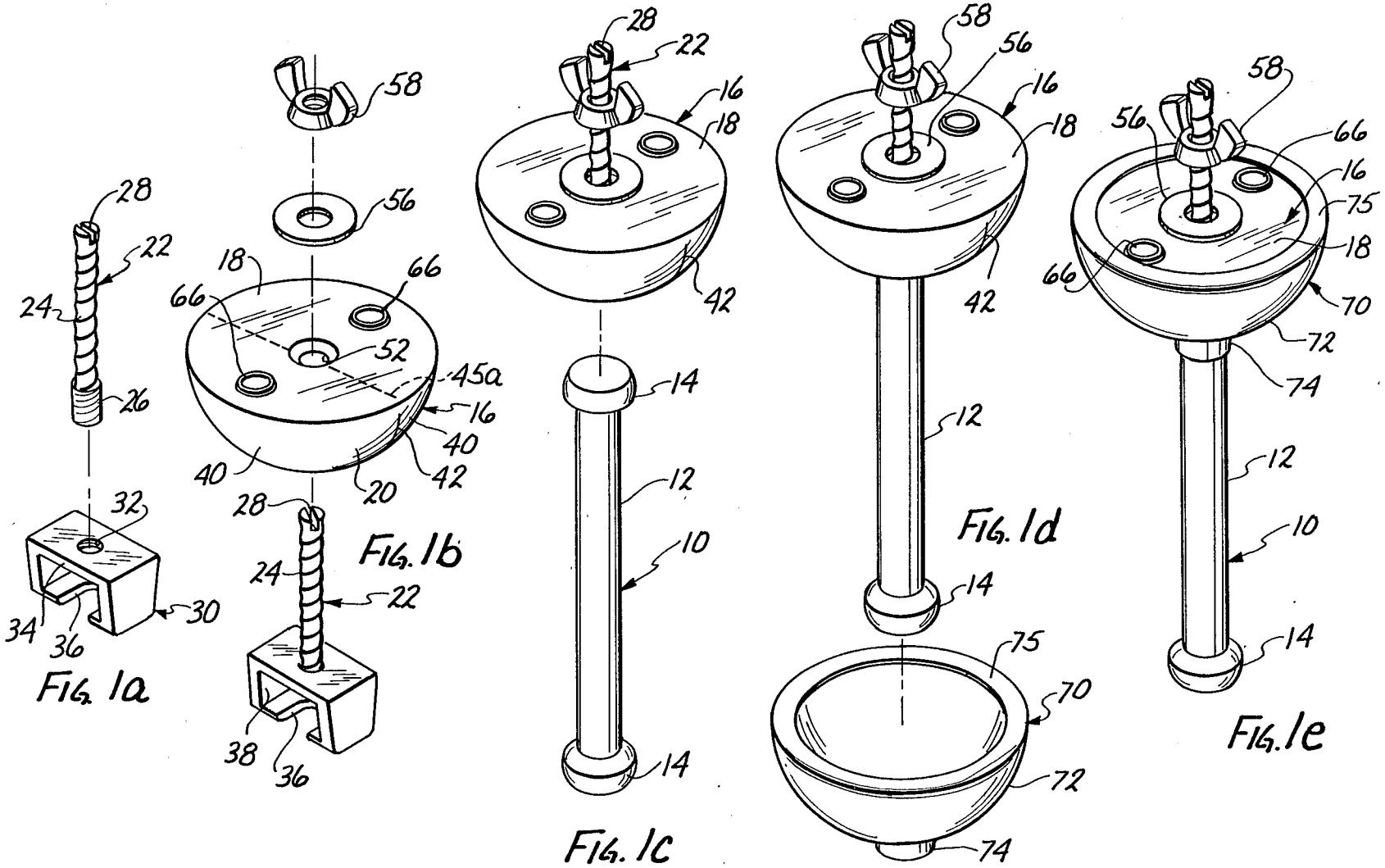
FIGS. 1*a* through 1*e* illustrate the assembly sequence of a first form of the anchor setting kit of this invention.

With reference to the drawings, wherein like elements are designated by like numerals, the sequence comprising FIGS. 1a through 1e illustrates the assembly of a kit of parts according to this invention for setting a hoist anchor 10 of the "dog bone" type i.e. comprising straight anchor shaft 12 terminating at each end in an enlarged anchor head 14 as shown in FIG. 1c. The kit of parts is shown in FIG. 1b and includes a hemispherical void body 16 made of hard rubber which has a flat circular upper surface 18 and a hemispherical undersurface 20. The kit further includes a setting stud 22 with coarse threading 24 along most of its length, fine threading 26 at its lower end as seen in FIG. 1a, and a driving slot 28 at its upper end for receiving the tip of a screwdriver or equivalent turning tool. An adapter frame 30 of generally rectangular configuation in side view has a threaded hole 32 centered in its upper side 34 for receiving the lower end of the setting stud 22 as in FIG. 1b. The lower side of the adapter frame has a "U" notch 36 which is sufficiently wide for receiving the anchor shaft 12 but undersized in relation to the diameter of the anchor head 14. The adapter frame 30 is fitted onto one end of the anchor 10 such that the anchor head 14 is received within the rectangular interior 38 of the frame 30 while the shaft 12 lies within the notch 36. The frame 30 then cannot be pulled off in an axial direction away from the anchor 10, but must instead be separated in a lateral direction.

Figure 2:
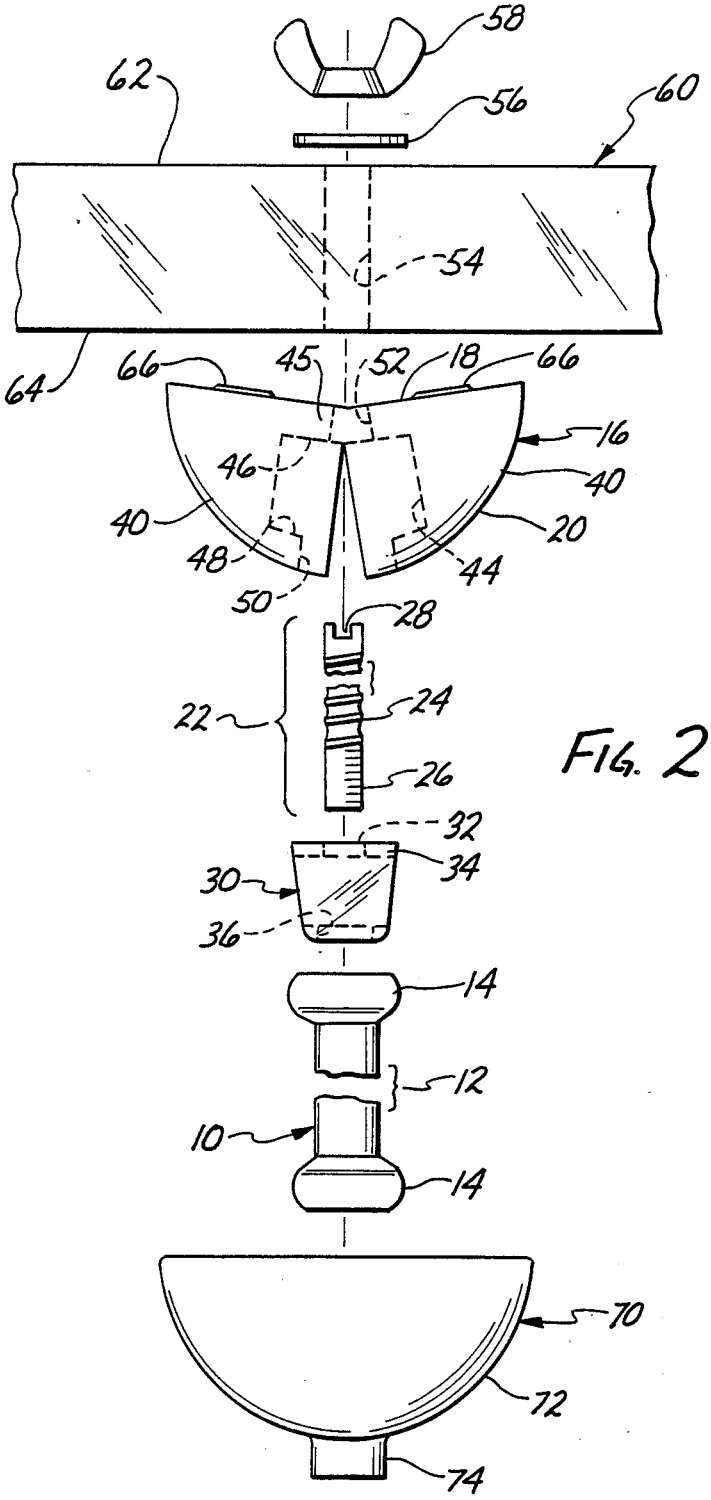
FIG. 2 is an axially exploded view of the assembly of FIG. 1*e* in relation to a concrete forming member to which the anchor setting kit is mounted prior to pouring of concrete.
Figure 3:
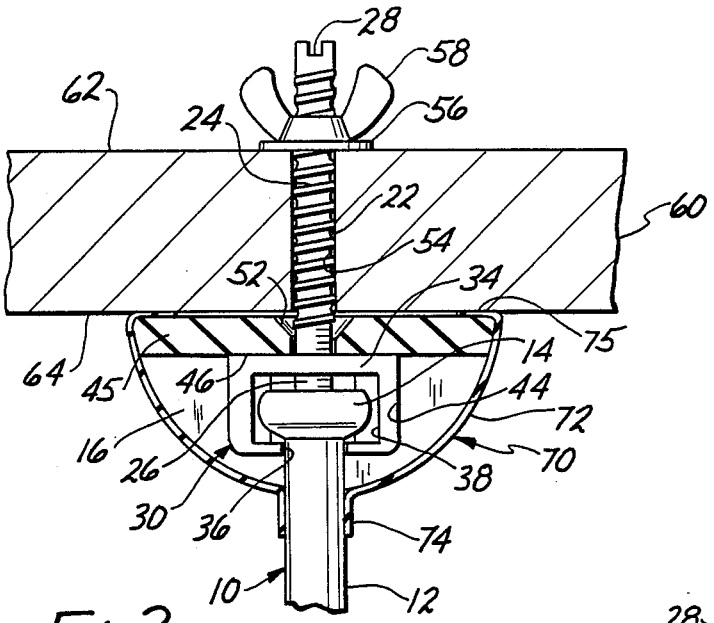
FIG. 3 is a cross-sectional view of the anchor setting kit of FIGS. 1 and 2 mounted to a concrete forming member.

The void body 16 is split into two equal halves 40 along a meridian arc 42 which, however, stops short of the top surface 18 at both its ends so as to leave the two halves 40 connected by a relatively small thickness of rubber 45 adjacent to the flat side 18 as best understood by reference to FIGS. 2 and 3. This connecting thickness 45 of rubber material serves as a hinge connecting to two halves 40 and allows them to be resiliently spread apart as in FIG. 2, to provide access into an anchor head receiving cavity 44 defined within the void body 16. The cavity 44 has an upper end wall 46 and an annular shoulder 48 about an opening 50 which is centered in the hemispherical underside 20. The cavity 44 is dimensioned for accommodating the adapter frame 30 and an anchor head 14 within the frame 30, with the anchor shaft 12 extending from the void body 16 through the opening 50. With the two halves 40 joined together along the split line 42, the shoulder 48 retains the bracket 30 as well as the anchor head 14 within the void body.

The kit is assembled by threading the lower end 26 of the mounting stud 22 into the hole 32 of the frame adapter 30. The free, slotted upper end 28 of the mounting stud is then inserted through the bottom opening 50 and cavity 44 of the void body 16, and then through a stud hole 52 which opens in the center of the flat top surface 18 and communicates with the cavity 44, as indicated in dotted lining in FIG. 2. The mounting stud 22 thus passes axially through the void body 16 with its free end and most of its length protruding from the center of the flat top side 18 as in FIG. 1b. The void body 16 is spread open along the split line 42 sufficiently to admit the frame adapter 30 into the cavity 44 with the top side 34 of the adapter frame against the end wall 46 of the cavity 44, a condition illustrated in FIG. 1c. One end of the anchor 10 is then pushed into the cavity 44 in the void body and fitted into the interior 38 of the adapter frame 30 so that an achor head 14 is received within the frame adapter 30 axially aligned with the setting stud. The void body 16 is then closed along the split line 42 whereupon the frame 30 and one end of anchor 10 will be fully enclosed and retained within the void body 16. The assembly is now ready for mounting to a concrete forming member 60. The concrete form is typically constructed of wooden borads which define a mold cavity having the shape intended for the concrete structure. Fluid concrete is poured into the form cavity where it sets and upon hardening retains the shape of the form cavity after the wooden form is disassembled. The exposed portion of the setting stud 22 is passed through a mounting hole 54 in the wooden board 60 of the concrete form. A washer 56 is then slipped onto the end of the mounting stud 22 protruding from the exterior side 62 of the form member 60, and a butterfly nut 58 is then screwed on the coarse threading 24 on the exteriorly protruding portion of the mounting stud. The retaining nut 58 and washer 56 are tightened against the outer surface 62 of the form member so as to draw the flat side 18 of the void body 16 firmly against the inner side 64 of the form member, flattening the top surface 18 of the void body. This has the effect of urging the two halves 40 together to firmly close the slit line 42 and bringing the rim of the hole 50 firmly against the anchor shaft 12 in order to seal the interior of the void body against seepage of the fluid concrete.

In order to enhance the sealing of the void body interior, a pair of raised annular protuberances 66 are formed on the upper surface 18 of the void body, one on each half 40 of the void body such that when the center of the disk 18 is drawn up against the concrete form surface 64 by pressure applied against the cavity end wall 46 by the adapter frame 30, the protuberances 66 operate to push down on the two halves 40 on each side of the hinge line 45*a* suggested in FIG. 1*b* and thus pivot them towards each other about the frame adapter 30 with the result that the edges of the two halves 40 along the split line 42 are more firmly pressed together against each other and against the anchor shaft 12.

Still more secure sealing of the interior of the void body 16 may be had by fitting a shield 70 over the void body as shown in FIGS. 1*d*, 1*e* and FIG. 3. The shield 70 is made of a single piece of relatively thin latex sheet material and includes a hemispherical skirt 72 sized to fit closely over the hemispherical undersurface 20 of the void body 16, an annular inward fold 75 at its upper end which folds over the top surface 18 of the void body to retain the shield 70 in place, and a bottom opening into a short tubular sleeve 74. Installation of the latex shield 70 is done before the void body is tightened against the concrete form 60. The shield 70 is slipped upwardly on the exposed portion of the anchor 10 and onto the underside of the rubber void body 16 until the retaining fold 75 fits over the upper surface 18 of the void body. The hemispherical skirt fully covers the slit opening 42 while the sleeve 74 snugly grips a portion of the anchor shaft 12 just below the void body opening 50 to form an elastic seal over that opening. The assembly is then mounted to the form 60 and the surface 18 of the void body drawn up against the concrete forming surface 64, thereby capturing the flange as shown in FIGS. 3,5,6 and 9, the hold the skirt 72 securely in place over the void body during pouring of concrete into the form and over the anchor and void body. After the anchor has been set and the concrete hardened around the void body, the latex shield 70 may be left in place in the resultant hemispherical depression around the anchor after the void body 16 has been cut away and discarded. To further improve the sealing properties of the latex shield, the sleeve 74 may extend further along the anchor shaft 12 e.g. over one-third or even one-half the length of the anchor shaft.

It will be apparent that some of the steps described in the assembly sequence of FIGS. 1*a* through 1*e* may be carried out in an order other than that presented above. For example, the anchor 10 may be fitted to the frame adapter 30 prior to insertion of the frame adapter and mounting stud into the void body 16.

The mounting stud 22 is preferably tightened down against the anchor head 14 captive within the frame adapter 30, so as to press the anchor head 14 down and clamp it against the rim of the slot 36, locking the anchor head in an interference fit between the bottom end of the mounting stud 22 and the frame adapter 30 while the assembly is mounted to the concrete forming member 60. After the concrete has set, the butterfly nut 58 and the mounting stud 22 are removed, freeing the anchor head 14 for separation from the frame bracket 30. During the concrete pouring operation, however, the anchor 10 is positively secured to the void body 16 by the aforedescribed clamping action of the mounting stud.

Figure 4:
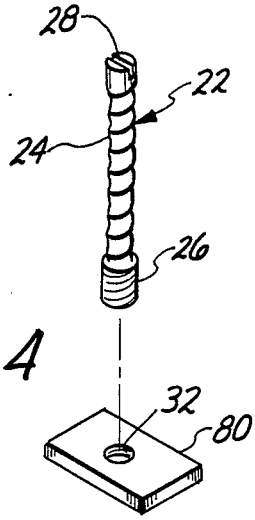
FIG. 4 shows an laternate threaded washer is substituted in the kit of FIGS. 1*a* through 1*e* in a second form of the invention.
Figure 5:
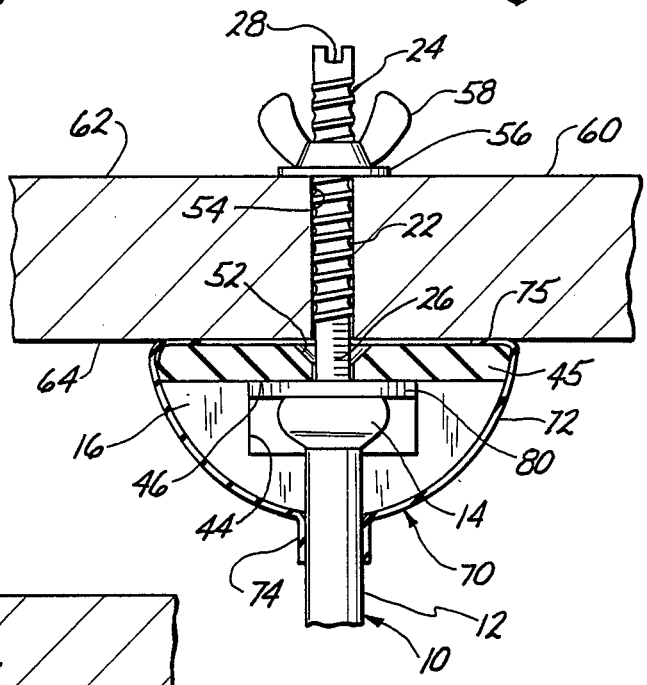
FIG. 5 shows an axial cross section of the assembled kit as in FIG. 3 but using the alternate washer of FIG. 4.

FIG. 4 and 5 describe a second embodiment of the invention wherein all parts of the kit shown in FIGS. 1*a* through 1*e* are the same except that the frame adapter 30 has been replaced by a flat rectangular washer plate 80 in which a threaded hole 32 equivalent to the similarly numbered hole in the frame adapter 30 of FIG. 1a is provided for receiving the threaded lower end 26 of the mounting stud 22. The assembly of the anchor setting kit is an described in connection with FIGS. 1*a*–1*e* with the washer plate 80 taking the place of the frame adapter 30. The washer plate 80 does not capture the anchor head 14 but does serve to draw the top surface 18 of the void body 16 firmly against the concrete forming surface 64 to thereby urge the two halves 42 of the void body together and close the slit opening 42, the anchor head being in this case retained between the two halves which in many applications will be sufficient for holding the anchor 10 is place until the concrete has been poured and has set.

Figure 6:
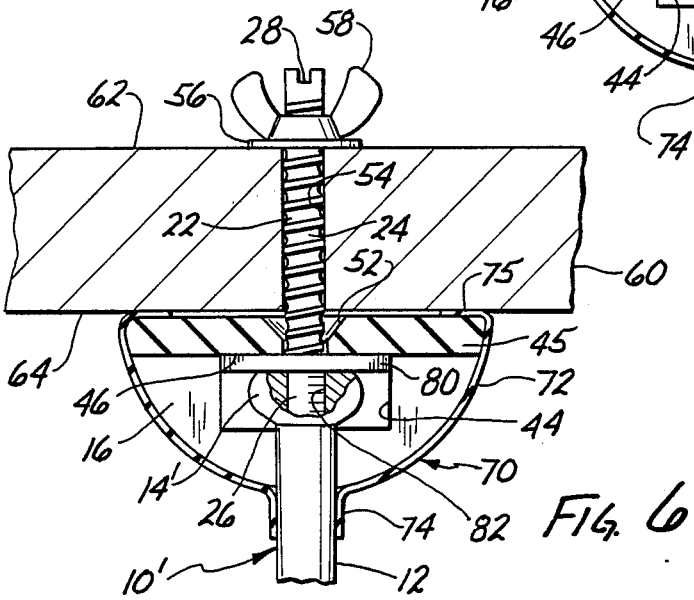
FIG. 6 is a view as in FIG. 5 but showing still a third embodiment of the invention using a threaded anchor.
Figures 7A, 7B, 7C, 7D, 7E:
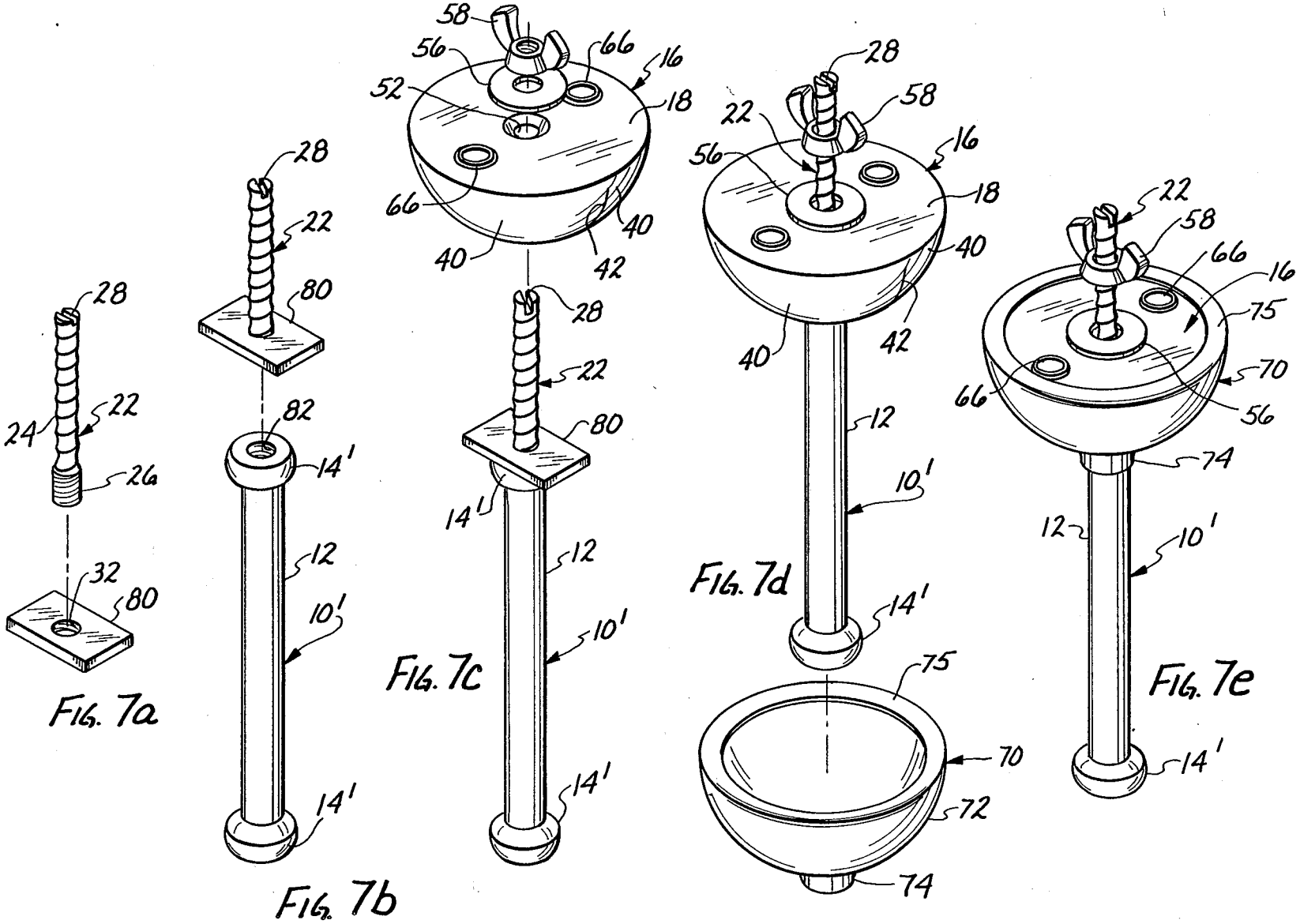
FIGS. 7*a* through 7*e* illustrate the assembly sequence of the anchor setting kit using a threaded anchor resulting in the assembly of FIG. 6.

A third embdiment of the present invention is illustrated in FIG. 6 and the assembly sequence for this third embodiment is shown in FIGS. 7*a*–7*e*. In this third form of the invention, a flat washer plate 80 is employed as in FIG. 4, but the anchor 10' is drilled and tapped axially at least at one of its ends. FIG. 7*b* shows the modified anchor 10' with an axial blind hole 82 drilled in its upper end and internally threaded for receiving the threaded end 26 of the mounting stud 22. The opposite, lower end of the anchor 10' may be likewise drilled and tapped. The assembly of this third form of the invention proceeds as illustrated in the sequence of FIGS. 7*a* to 7*e*, by first threading the mounting stud 22 through the washer plate 80 as in FIG. 7*a*, then threading the end 26 of the mounting stud into the axial hole 82 of the anchor 10' as in FIG. 7*b* after which this sub-assembly is inserted into the hemispherical void body 16 by spreading apart the two halves 40 and inserting the washer plate 80 into the anchor head receiving cavity 44 within the void body, all as explained in connection with previous embodiments and as suggested in FIG. 7*c*. The assembly at this stage is ready for mounting to the inner surface 64 of a concrete forming member as shown in the cross-section of FIG. 6 in a manner similar to the first two embodiments explained earlier. Optionally, a latex shield 70 similar to that described and illustrated in connection with FIGS. 1*d*, 1*e* and FIG. 3 may be fitted onto the anchor 10' and void body 16 as also shown in FIGS. 7*d*, 7*e* and FIG. 6. In this form of the invention, the anchor 10' is positively retained to the void body 16 by threading engagement with the setting stud 22 while at the same time the washer plate 80 is drawn upwardly against the end wall 46 of the anchor head receiving cavity 44 in the void body 16 when mounted to the concrete forming member 60 as in FIG. 6. The plate 80 is drawn up by tightening of the retaining nut 58 which pulls the center of the void body against the concrete forming surface 64 thereby pressing down and flattening the top surface 18, an effect enhanced by the raised areas 66 with the result that the two halves 40 are urged towards each other along the split line 42 and against the shaft 12 of the anchor 10'.

Figure 8:
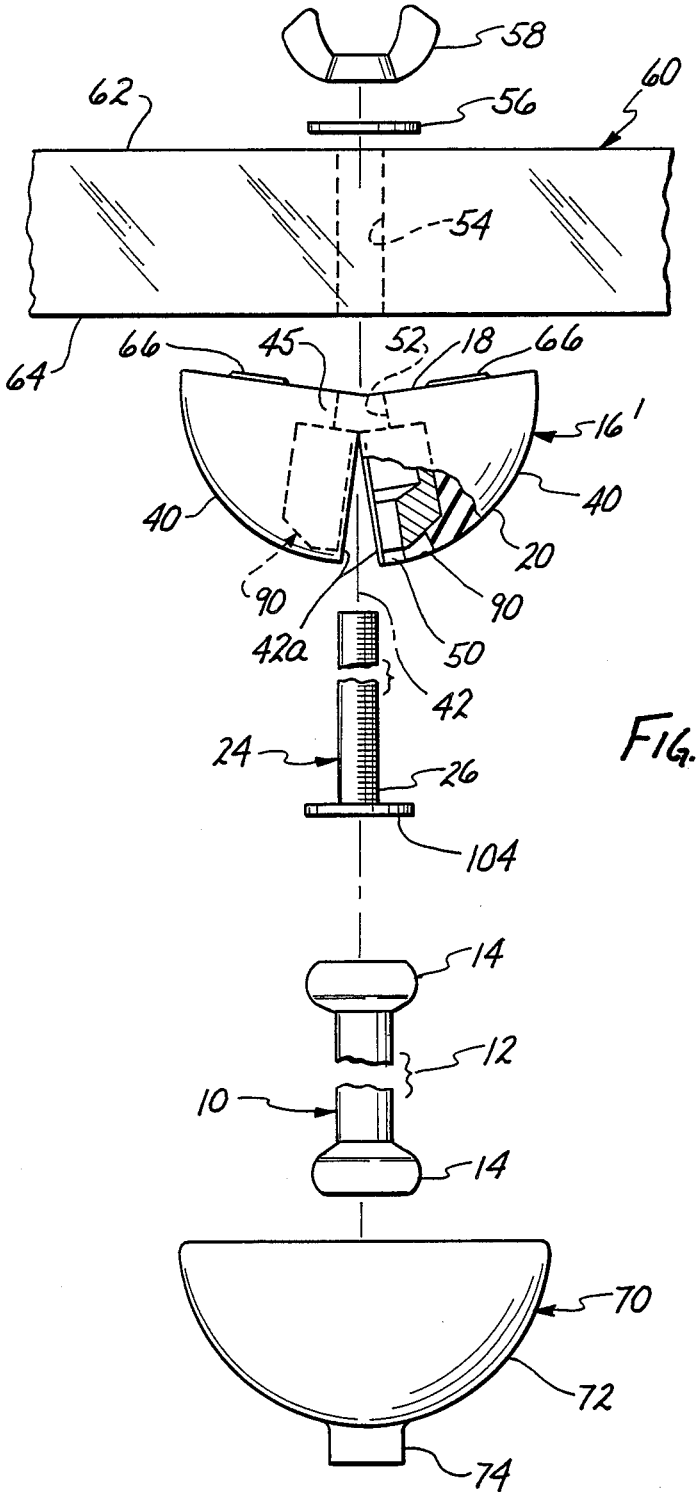
FIG. 8 is a longitudinally exploded axial view of a fourth alternate anchor setting kit using a composite material hemispherical void body.
Figure 9:
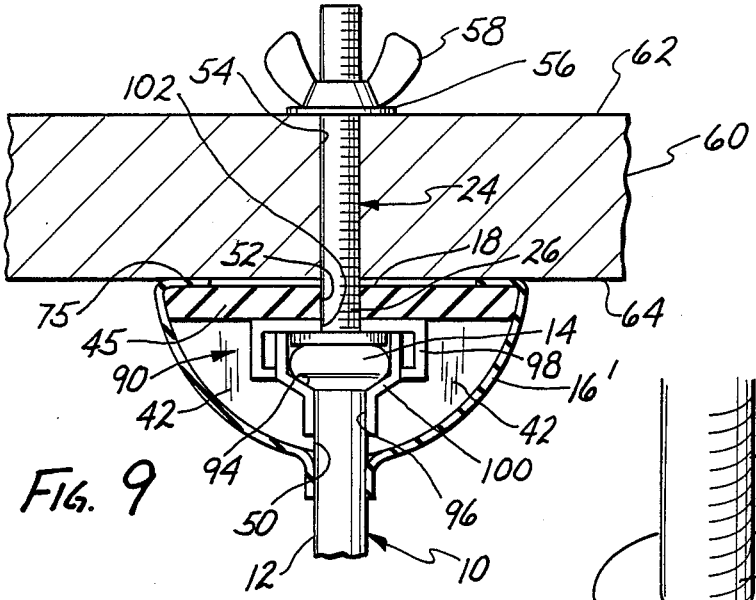
FIG. 9 shows the kit of FIG. 8 in cross-section assembled to a concrete forming element.
Figure 10:
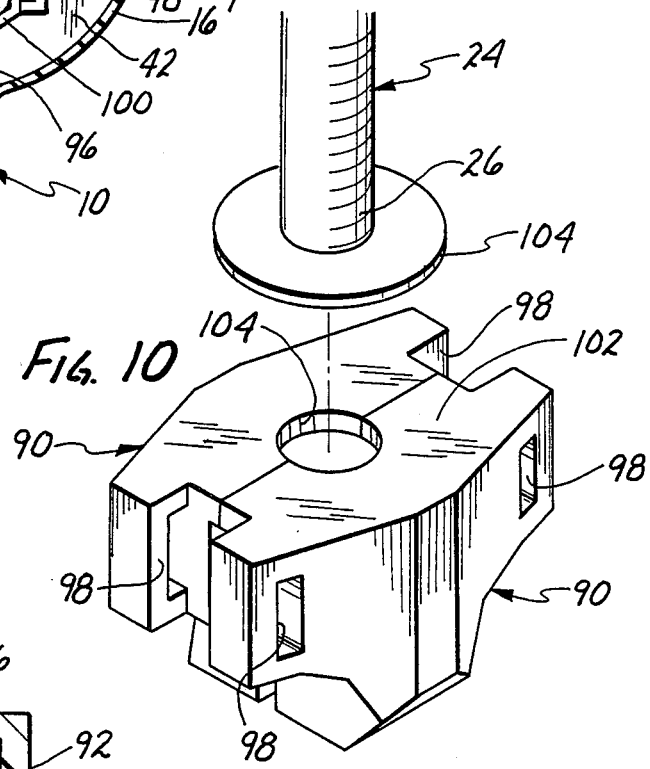
FIG. 10 is a perspective view of the metallic elements embedded in the void body of FIG. 8 and the retaining washer threaded on the inner end of the mounting stud.
Figure 11:
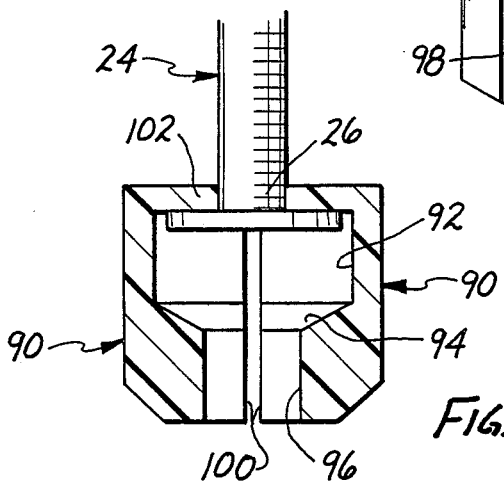
FIG. 11 isi a longitudinal section showing the stud end captive within the metallic shell of FIG. 10 with the surrounding rubber material removed for simplicity.

Turning now to FIGS. 8–11, a still further, fourth embodiment of the invention is illustrated in which a pair of complementary metallic elements 90 are embedded in the rubber material of the void body 16'. FIG. 10 shows the two complementary elements 90 joined to make up a hollow shell with an internal cavity 92, seen in cross-section in FIG. 11. The shell cavity 92 is shaped to complement the head 14 of a hoist anchor 12. The cavity 92 includes an annular seat 94 encompassing a throat opening 96 of reduced diameter in relation to the diameter of cavity 92, and dimensioned to closely encompass the anchor shaft 12 shown in FIGS. 8 and 9. Each metallic element 90 is embedded in one half 40 of the rubber void 16' in mutually opposing relationship so as to define the cavity 92 when the void body 16' is closed along the dividing plane 42. Each element 90 has laterally projecting ear portions 98 which are apertured to allow flowthrough of rubber material creating an interlock with the metallic elements 90 during manufacture of the composite void body 16' so that each element 90 is permanently and securely anchored in the rubber material, with only the mutually opposing faces 100 exposed and slightly recessed from the opposing rubber surfaces 42*a*. The complementary elements 90 together also define an end wall 102 closing the upper end of the shell cavity 92 which is apertured by a hole 104 aligned with the stud hole 52 in the rubber body 16', such that the lower threaded end 26 of a mounting stud 24 may be inserted into the cavity 92 through the aligned holes, as shown in FIG. 9. A retaining washer 104 is threaded onto the stud end 26 within the cavity 92 while the void body is spread open so as to make an interference fit with the end wall 102 and prevent upward removal of the stud 24 while elements 90 are joined together, i.e., the void body 16' is closed along the dividing plane 42. Anchor head 14 of a hoist anchor 10 may then be inserted into the cavity 92, again while holding open the two halves 40 of the void body, as has already been explained above. The exposed upper end of the mounting stud 24 is then inserted through a mounting hole 54 in a concrete forming member 60 and the assembly is secured thereto by means of a washer 56 and retaining nut 58 threaded on the outer end of the stud, all as shown in FIGS. 8 and 9. Tightening the butterly nut 58 tends to draw the stud 24 and retaining washer 104 against the end wall 102 of the shell cavity pulling the joined elements 90 up against the rubber layer 45 joining the two halves 44 and flattening the upper surface 18 of the void body against the plane inner surface 64 of the concrete form 60. The effect is to urge a limited central area of the void body surface 18 against the concrete forming surface 64, consequently forcing the surface 18 to a planar condition which in turn forces the two halves 40 and the complementary metallic elements 90 against each other, securely capturing the anchor head 14 between the elements 90 in the shell cavity 92. The rubber material surrounding the metallic elements 90 projects slightly around the metallic elements 90 forming an effective seal against fluid concrete when the faces 42a are forced together. The anchor shaft 12 is encompasses by rubber material defining a central hole 50 aligned with the throat opening 96 in the shell cavity 92 as shown in FIGS. 8 and 9.

As explained with earlier described embodiments, the hemispherical void body 16' may be provided with raised elements 66 on the top surface 18 preferably along a diametric line perpendicular to the dividing plane 42, on each half 40. These raised elements 66 act as wedges between the void body and the concrete forming surface 64 to enhance the sealing effect when the center area of the void body lying between the raised elements 66 is drawn up against the form element 60 by means of stud 24. Further, the composite void body 16' may, as in earlier described forms of this invention, be provided with a latex seal 70 as shown in FIGS. 8 and 9 for additional protection against entry of fluid concrete between the surfaces 42*a*.

Figure 12C:
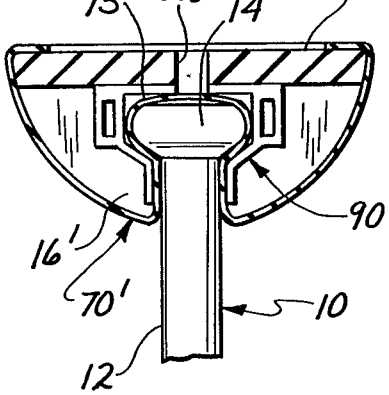
FIGS. 12*a* through 12*c* show the application of a closed latex shield between the anchor and the void body.
Figure 12B:
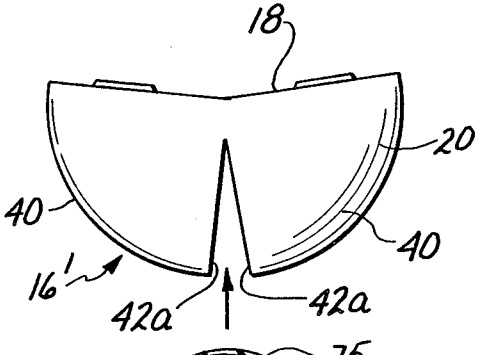
Figure 12B:
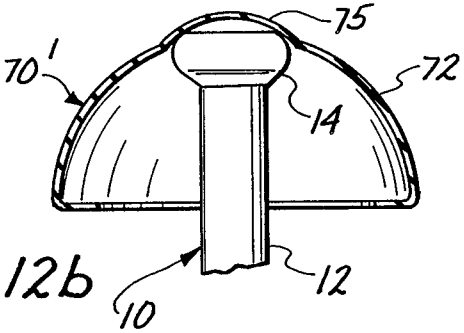
Figure 12A:
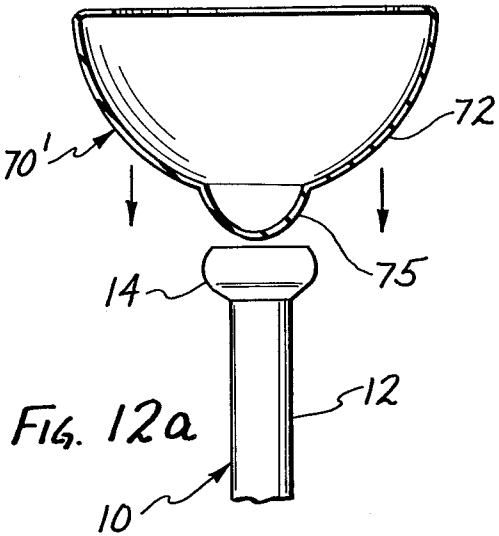

FIGS. 12*a* through 12*c* illustrate the sequence of application of an alternate latex seal or shield unit 70' which has a hemispherical skirt 72 with a closed nipple 75 at its center formed as one continuous thin sheet of latex. The seal 70' is applied over an anchor head 14 by positioning the shield 70' with the nipple over the anchor head as shown in FIG. 12*a* and then pulling down the skirt 72 to turn it inside out over the anchor head 14 as in FIG. 12*b*. The anchor head covered with the inverted shield 70' is then inserted into a void body 16 or 16', as indicated in FIG. 12*b*, pushing the nipple covered anchor head into the head receiving cavity while most of the hemispherical latex skirt remains outside the void body. The exterior remainder of the latex shield 70' is then pulled up, i.e. is now turned outside in, over the hemispherical surface 20 of the void body 16, as in FIG. 12*c*. The latex seal 70' thus provides a continuous impermeable barrier between the void body 16' on one side and the anchor head and cement on the opposite side of the latex sheet to positively prevent entry of cement into the void body.

While specific embodiments of the present invention have been described and illustrated for purposes of clarity and example, it will be understood that many changes, modifications and substitutions to the described embodiments will become apparent to those possessed of ordinary skill in the art without departing from the spirit and scope of the present invention which is defined by the following claims.

What is claimed is:

1. A kit of parts for use in setting a hoist anchor in a poured concrete structure comprising:

a hemispherical rubber void body having an anchor head receiving cavity therein, said body and cavity split into two quarter sphere halves joined at a flat side of said body to allow hinging separation of said halves for insertion of an anchor head into said cavity;

a threaded setting stud insertable into said cavity through a stud hole centered in said flat side of the void body;

a hoist anchor including an anchor shaft terminating in an enlarged anchor head insertable into said receiving cavity;

washer means in said cavity between said anchor head and said flat side for threadingly receiving one end of said stud;

retaining nut means threadable on an exposed portion of said stud against the outer surface of a concrete forming member perforated to admit said stud for drawing said flat side of the void body against an inner surface of said forming member thereby to force said halves together about said anchor thus to close said cavity against fluid concrete.

2. The kit of claim 1 wherein said stud is threaded through said washer means and into said anchor head thereby to secure said anchor to said void body during pouring and setting of concrete in said form.

3. The kit of claim 1 wherein said washer means comprise an adaptor frame configured to encompass and capture said anchor head against axial withdrawal from said cavity thereby to secure said anchor to said void body during pouring and setting of concrete in said form.

4. The kit of claim 1 further comprising raised portions on said flat surface of the void body on each side of the hinge line joining said two halves, said raised portions acting as wedges between the concrete forming member and said void body for more firmly urging together said two halves and enhancing the seal along said split line.

5. The kit of claim 1 further comprising a shield of impermeable elastic unitary sheet material fitted over and closely conforming to the hemispherical shape of said body, said shield being apertured to closely pass said hoist anchor shaft for sealing the split void body against entry of fluid concrete into said split or said cavity.

6. The kit of claim 5 wherein said shield includes a hemispherical skirt with an annular retaining fold extending inwardly from the wide end of said skirt, and an intergral tubular extension dimensioned for elastically gripping said anchor shaft.

7. In combination, a split hemispherical rubber void of the type including an anchor head receiving cavity for setting hoist anchors having a shaft and an anchor head in poured concrete structure, and a shield of impemeable elastic unitary sheet material fitted over and closely conforming to the hemispherical shape of said body, said shield being apertured to closely pass the shaft of a hoist anchor for sealing the split void body against entry of fluid concrete into said split or said cavity.

8. The combination of claim 7 wherein said shield includes a hemispherical skirt with an annular retaining fold extending inwardly from the wide end of said skirt, and an integral tubular sleeve extension about an opening centered in said skirt, said sleeve extension dimensioned for elastically gripping said anchor shaft.

9. In combination, a split hemispherical rubber void of the type including an anchor head receiving cavity used for setting hoist anchors in poured concrete structures, and a generally hemispherical unitary shield of impermeable sheet material adapted to fit over an anchor head in said cavity and to cover the exterior hemispherical surface of said void body thereby to provide a continuous fluid-tight barrier between said void body on one side and the anchor on the opposite side for sealing the void body against entry of fluid concrete during setting of the anchor.

10. A method for setting hoist anchors in a poured concrete structure using a hemispherical rubber void body having an anchor head receiving cavity therein, the body and cavity being split into two halves joined at a flat side of the body to allow hinging separation of said halves, a threaded setting stud, a hoist anchor including an anchor shaft terminating in an enlarged anchor head, and a threaded washer, comprising the steps of:

threading one end of said stud into said washer;

inserting said stud through a stud hole in the void body opening into the cavity such that the washer is disposed against an upper wall of the cavity and a portion of the stud extends from the flat side of the body;

inserting the anchor head into said receiving cavity;

inserting said exposed portion of the stud through a wooden concrete form perforated to admit said stud; and threading a retaining nut on the exposed end of the stud and tightening the nut against an outer surface of the form for drawing the flat side of the void body against an inner surface of the form thereby to force the halves together about the anchor to close the cavity against concrete to be poured into the form.

11. The method of claim 10 further comprising the step of drawing an impermeable shield over said hoist anchor and onto said void body, said shield being of impermeable elastic sheet material conforming to the hemispherical shape of said body and apertured to make a substantially leakproof seal with said hoist anchor shaft for sealing said split and said cavity against fluid concrete.

12. A kit for use in setting a hoist anchor of the type having an anchor shaft terminating at least at one end in an enlarged anchor head in a poured concrete structure, comprising:

a hemispherical rubber void body having an anchor head receiving cavity therein, said body and cavity split into two quarter sphere halves hingedly joined at a flat side of said body to allow hinging separation of said halves for insertion of an anchor head into said cavity; and mounting means for drawing the center of said flat side against a concrete forming member thereby to urge said halves against each other and seal said split against fluid concrete;

said void body having raised portions on said flat surface of the void body on each side of the hinge line joining said two halves, said raised portions acting as wedges between the concrete forming member and said void body for more firmly urging together said two halves and enhancing the sealing of said split.

13. The kit of claim 12 further comprising impermeable shield means fitted over said hemispherical undersurface and closely passing said anchor shaft for further sealing said void body cavity.

14. A method for setting a hoist anchor of the type having an anchor shaft terminating at least at one end in an enlarged anchor head in a poured concrete structure, comprising:

providing a hemispherical rubber void body having an anchor head receiving cavity therein, said body and cavity split into two quarter sphere halves hingedly joined at a flat side of said body to allow hinging separation of said halves for insertion of an anchor head into said cavity;

drawing the center of said flat side against a concrete forming member thereby to urge said halves against each other and seal said split against fluid concrete; and fitting an impermeable shield over said hemispherical body and said anchor shaft for further sealing said void body cavity.

15. A kit of parts for use in setting a hoist anchor in poured concrete, the anchor including an anchor shaft terminating in an enlarged anchor head at least at one end thereof, comprising:

a hemispherical rubber void body partially split into two halves joined by a layer of rubber at a flat side of said body to allow hinging separation of said halves;

a metallic shell divided into two complementary halves together defining a shell cavity adapted to capture an anchor head placed therebetween, each said complementary half being embedded in one said half of the void body in mutually opposing relationship;

a threaded setting stud insertable into said shell cavity through a stud hole centered in said flat side of the void body;

means for retaining said stud against withdrawal from said shell cavity;

retaining nut means threadable on an exposed portion of said stud against the outer surface of a concrete form perforated to admit said stud for drawing said flat side of the void body against a planar inner surface of said form thereby to force together said void body halves and said complementary halves thereby to capture an anchor head inserted therebetween and close said shell cavity against entry of fluid concrete.

16. The kit of claim 15 wherein said means for engaging comprise washer means threadable onto one end of said stud within said cavity to make an interference fit with an apertured end wall of said shell cavity thereby to prevent subsequent withdrawal of said stud end.

17. The kit of claim 15 further comprising a shield including a hemispherical latex skirt adapted to fit closely over said void body and having an annular retaining fold extending inwardly over said flat side from the wide end of said skirt, and an integral tubular extension about an opening centered in said skirt, said tubular extension dimensioned for elastically gripping the shaft of an anchor captive in said void body.

18. A void body for setting a hoist anchor in poured concrete, the anchor having a shaft terminating in at least one enlarged anchor head, comprising:

a hemispherical rubber void body partially split into two halves joined by a layer of rubber at a flat side of said body to allow hinging separation of said halves;

a metallic shell divided into two halves together defining a shell cavity adapted to capture an anchor head placed therebetween, each said half being embedded in one said half of the void body in mutually opposing relationship; and a stud hole centered in said flat side of the void body for admitting one end of a threaded setting stud into said cavity;

whereby said flat side of the void body may be drawn against an inner surface of a concrete form perforated to admit said stud by retaining means threadable on an exposed portion of said stud against the outer surface of said form thereby to force together said void body halves and said shell halves thereby to capture an anchor head inserted therebetween and close said cavity against entry of fluid concrete.

19. The void body of claim 18 further comprising raised elements on said flat side integral with said void body and radially spaced from said stud hole generally along a line perpendicular to a plane separating said void body halves, said raised elements acting as wedges between a concrete form and the void body to enhance the seal between said halves against fluid concrete.

20. In a hemispherical rubber void body partially split into two halves joined by a layer of rubber at a flat side of said body to allow hinging separation of said halves and having a stud hole centered in said flat side of the void body for admitting one end of a threaded setting stud into said cavity for setting a hoist anchor in a poured concrete structure, the anchor including an anchor shaft terminating in an enlarged anchor head at least at one end thereof, the improvement comprising:

first and second metallic elements each embedded in one said half of the void body and together defining a cavity adapted to capture an anchor head placed therebetween.

21. The improvement of claim 20 further comprising means for retaining said stud end between said metallic means for drawing said flat side against a concrete forming surface thereby to urge said halves closed against entry of fluid concrete therebetween.

22. The improvement of claim 21 wherein said means for retaining comprise washer means threadable onto one end of said stud within said cavity to prevent subsequent withdrawal of said stud end.

23. A hemispherical rubber void body for setting hoist anchors in poured concrete having a hemispherical undersurface partially divided by a diametric plane into portions hingedly joined by a thickness of rubber along an upper surface, wherein the improvement comprises:

metallic complementary elements embedded in said portions and together defining a shell cavity conforming to a head of a hoist anchor; and a stud hole centered in said flat upper surface and opening into said shell cavity for admitting a threaded stud into said cavity;

whereby a retaining element may be threaded onto the stud end in said cavity for drawing said upper surface flat against a concrete forming surface so as to close said complementary elements and capture an anchor head inserted therebetween.

24. A method for setting a hoist anchor in poured concrete, the anchor having a shaft terminated in at least one enlarged anchor head, comprising the steps of:

providing a hemispherical rubber void body partially divided by a diametric plane into portions hingedly joined by a thickness of rubber along a flat upper surface and including metallic complementary elements embedded in said portions together defining a cavity conforming to a head of a hoist anchor;

inserting a threaded stud into said cavity through a stud hole centered in said flat upper surface;

threading a retaining element onto the stud end in said cavity;

inserting an anchor head into said cavity; and drawing said upper surface flat against a concrete forming surface so as to force closed said complementary elements and said rubber portions about the anchor therebetween.

25. The method of claim 24 further comprising the steps of:

providing a latex seal having a hemispherical skirt adapted to fit closely over said void body and having an annular retaining fold extending inwardly over said flat side from a wide circular rim of said skirt, and an intergral tubular extension about an opening centered in said skirt, said tubular extension dimensioned for elastically gripping the shaft of an anchor captive in said void body; and fitting said seal over said void body and an anchor inserted in said void body before said drawing step, such that following said drawing step said annular rim is held captive between the void body and the concrete form to secure the seal during subsequent pouring of concrete into the form.

26. A kit for use in setting a hoist anchor of the type having an anchor shaft terminating at least at one end in an enlarged anchor head in a poured concrete structure, comprising:

a hemispherical rubber void body having an anchor head receiving cavity therein, said body and cavity split into two quarter sphere halves hingedly joined at a flat side of said body to allow hinging separation of said halves for insertion of an anchor head into said cavity; and mounting means including a threaded rod engageable to an element within said cavity for retaining said rod to said body, said rod extending substantially exteriorly to said void body for insertion through a hole in the concrete forming member, and nut means threadable onto said rod exterior for securing said void body to a concrete forming member and also for drawing the center of said flat side against a concrete forming member by means of said element thereby to urge said halves against each other and seal said split against fluid concrete

* * * * *